US005951389A

United States Patent [19]

Hettes et al.

[11] Patent Number: 5,951,389

[45] Date of Patent: Sep. 14, 1999

[54] DRIVE SYSTEM FOR SMALL DIAMETER ABRASIVE DISCS

[75] Inventors: Frank J. Hettes, Greentown; Larry L. Mell, Lake Ariel; John Lee Sockman, Mt. Pocono, all of Pa.

[73] Assignee: Weiler Corporation, Cresco, Pa.

[21] Appl. No.: 08/833,570

[22] Filed: Apr. 7, 1997

Related U.S. Application Data

[63] Continuation-in-part of application No. 08/546,970, Oct. 23, 1995, Pat. No. 5,752,876.

[51] Int. Cl.[6] ..... B24D 13/16

[52] U.S. Cl. ..... 451/508; 451/468; 403/343

[58] Field of Search ..... 451/508, 509, 451/468, 466, 526, 510, 465, 464, 463, 537, 533, 529, 496; 403/343, 342; 411/263, 307, 308, 309

[56] References Cited

U.S. PATENT DOCUMENTS

| | | | |
|---|---|---|---|
| 2,383,231 | 8/1945 | Anderton | 411/308 |
| 2,958,593 | 11/1960 | Hoover et al. . | |
| 3,683,567 | 8/1972 | Ali | 451/490 |
| 3,800,483 | 4/1974 | Sherman | 451/508 |
| 4,437,271 | 3/1984 | McAvoy | 51/400 |
| 4,679,360 | 7/1987 | Eisenblätter | 51/337 |

FOREIGN PATENT DOCUMENTS

| | | | |
|---|---|---|---|
| 42 08 269 A 1 | 9/1993 | Germany . | |
| 0114470 | 6/1985 | Japan | 451/526 |
| 60-114470 | 6/1985 | Japan . | |
| 0876636 | 9/1981 | United Kingdom | 411/307 |

OTHER PUBLICATIONS

MAN Modern Application News, The Metalworking Idea Magazine, Fibre Discs vs. Flap Discs, Jun. 1994, vol. 28, No. 5.

Weiler Tiger Abrasives Product Catalog 1996, pp. 4–7 and 11.

*Primary Examiner*—Robert A. Rose

*Attorney, Agent, or Firm*—Seidel, Gonda, Lavorgna & Monaco, PC

[57] ABSTRACT

A drive system for engaging a small diameter abrasive disc with a power tool. The drive system includes an arbor which is adapted to engage the power tool. The arbor includes a shaft portion formed on one end and external threads formed on the other end. The external threads have a first pitch. The drive system also includes an abrasive disc backing plate which has a mount extending outward from the backing plate on one side of the backing plate. The mount has internal threads formed on it for threadingly engaging the threads formed on the arbor. The engagement of the threads in the mount with the threads on the arbor providing a rigid attachment for facilitating rotation of the disc by the power tool when the arbor is engaged with the power tool. The threads on the mount having a second pitch which is different from the first pitch. The difference in pitch locking the backing plate into engagement with the arbor. A stop is located between the shaft portion and the external threads which limits the extent of engagement between the threads in the mount and the threads on the arbor by contact between the mount and the stop. The location of the stop on the arbor is selected to permit complete engagement of the arbor with the disc after the disc is turned between about ¼ and about 1½ turns. The stop also configured to align the backing plate perpendicular to the axis of rotation of the arbor.

19 Claims, 6 Drawing Sheets

FIG. 9
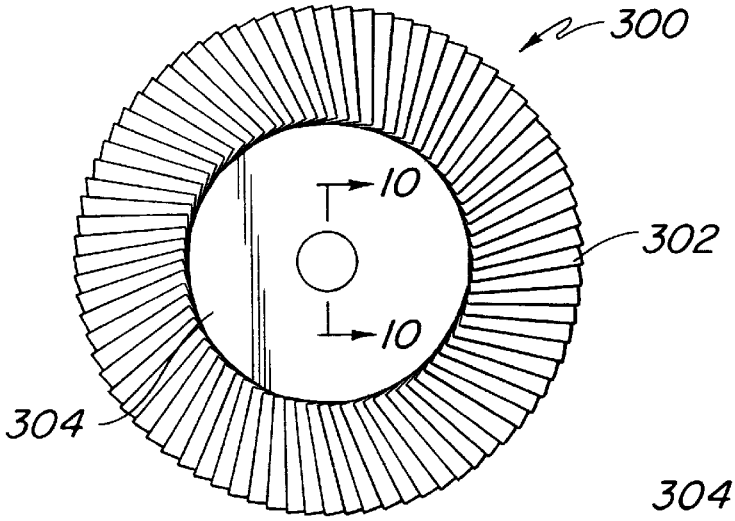
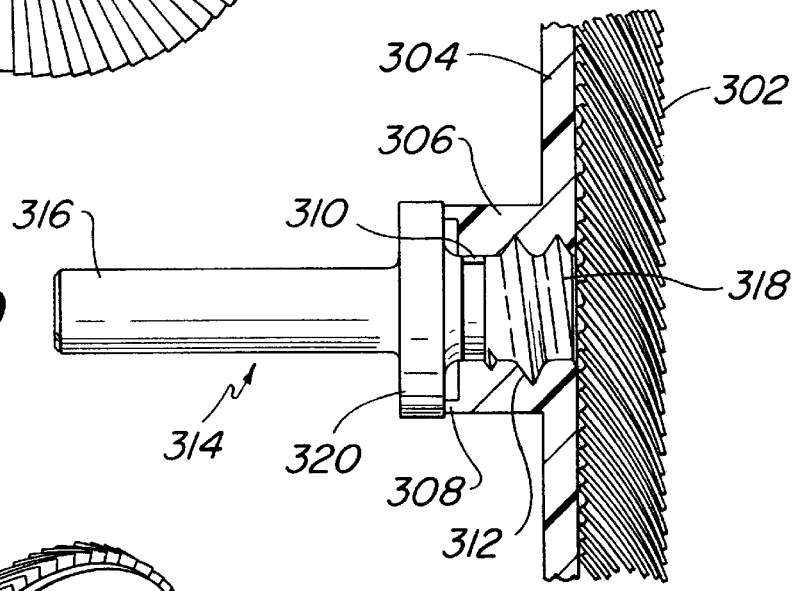
FIG. 10
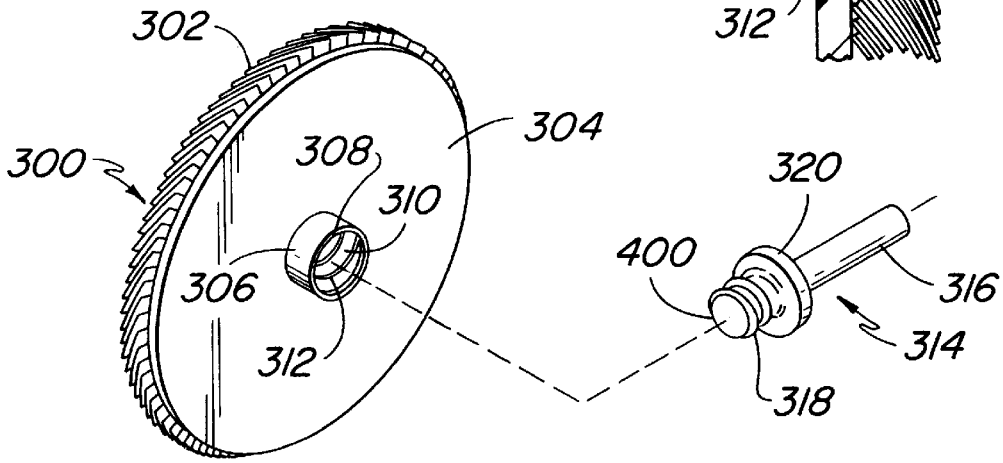
FIG. 11

DRIVE SYSTEM FOR SMALL DIAMETER ABRASIVE DISCS

CROSS-REFERENCE TO RELATED APPLICATIONS

This application is a continuation-in-part of application Ser. No. 08/546,970, entitled "Flap Disc Abrasive Tool", filed Oct. 23, 1995, now U.S. Pat. No. 5,752,876 which is incorporated herein by reference in its entirety.

FIELD OF THE INVENTION

The invention relates to surface finishing tools and, more particularly, to a drive system for removably attaching small diameter abrasive finishing discs to a standard finishing tool.

BACKGROUND OF THE INVENTION

Over the years, a variety of power tools, such as rotary sanders, have been developed for use in finishing the surface of a workpiece. Generally speaking, these tools rotate an abrasive material across the workpiece to scour or sand away the surface of the workpiece.

A rotary sander has a motor which drives a substantially planar disc, with abrasive elements bonded to it, in a circular motion across the work surface. The abrasive particles scrape off the top coating or surface of the work piece. A common type of disc used with these sanders comprises a fiber substrate onto which sharp, abrasive particles are securely bonded with a phenolic resin coating. The cured resin coating locks the sharp abrasive particles onto a fiber substrate. Rotary sanders are relatively inexpensive and easy to use and, accordingly, are very popular in surface finishing.

Two factors that must be considered when designing an abrasive disc for a rotary disc system are the life of the disc and the drive system that will rotate the disc. If the life of the disc is relatively short, the operator will need to change the disc quite often during a finishing operation. In such cases, it is desirable to design the disc to be quickly and easily removable from the drive unit. This is especially critical for small diameter discs which wear more quickly than larger diameter discs. Small diameter discs are finishing discs which are typically mounted to conventional ¼ inch or 6 mm drive arbors.

The drive system chosen for attaching small diameter discs to power tools varies depending on the type of finishing disc. For instance, finishing discs which include a thick plastic backing plate usually have a metal insert press-fit or bonded into a hole formed through the backing plate. The metal insert has standard Unified coarse internal threads (UNC) formed in it which mate with corresponding UNC external threads formed on the arbor. It has been common practice to utilize a number of threads per inch of between 18 and 24. However, the large number of threads per inch also requires that the disc be turned a considerable number of times before it is fully engaged with the arbor. This increases the time it takes to change a worn disc and, thus, increases the time it takes to complete a surface finishing operation.

Small diameter discs that do not have a separate rigid backing plate but, instead consist of a thin layer of resin impregnated fiber material, utilize a different mounting arrangement. For these discs, a metallic grommet is adhesively attached to the back of the resin fiber material. Since the thin layer of resin impregnated fiber material does not have much stiffness, a separate universal support, called a blending disc holder, is used to add rigidity to the disc during use. The holder is made from rubber material and is generally conical or bell shaped. The wide end of the holder is flat and has a male threaded mount imbedded in the center. The threaded mount is configured to engage the grommet to attach the disc to the holder. The threads on the male mount are typically not standard UNC threads but, instead, have about eight threads per inch. The narrow end of the holder has a metal insert imbedded into it which has a set of female (internal) UNC threads formed in the insert. The female UNC threads are ¼-20-UNC. The female threads engage with complimentary male (external) threads formed on a separate drive arbor. The advantage to this type of arrangement is the ability to change discs without removing the drive arbor from the power tool. One deficiency with this arrangement is that the grommets do not provide adequate support. It is quite common for the grommets to tear off the backing plate or disengage from the threads. Also, the combination of the holder and the disc is relatively heavy, increasing operator fatigue over long periods of use. The holder and disc combination is also relatively expensive.

Some small diameter discs are designed with arbors fixedly attached to the disc. The arbors are engaged with the drive system through a conventional chuck arrangement. A chuck key is used to tighten the jaws of the chuck around the arbor. When it is time to replace the disc, the operator must locate the chuck key and disengage the chuck jaws from the arbor. The disc/arbor combination is then discarded and replaced. This type of mounting arrangement is costly and is time consuming when replacing discs.

Another concern that must be addressed occurs when designing a drive system for attaching a finishing disc to a drive tool with a brake. The braking system on these types of tools provides relatively instantaneous stopping of the drive arbor. If the drive system is not designed correctly, the angular momentum of the finishing disc could result in disengagement of the disc from the drive arbor, with the danger of a disc flying off and striking someone.

A need therefore exists for an improved drive system for a finishing disc which permits easy engagement and disengagement from a power tool while prohibiting tear-out of an arbor from a disc. A need also exists for a drive system that prevents disengagement of the finishing disc when used on a drive tool with a brake.

SUMMARY OF THE INVENTION

An object of the present invention is to provide an improved drive system for mounting a small diameter finishing disc to a rotary power tool co which is strong and easy to engage/disengage.

Another object of the present invention is to provide an improved drive system which inhibits inadvertent disengagement of a finishing disc when the drive tool is stopped.

Yet another object of the invention is to provide a disc with abrasive flaps formed thereon that is easily engagable with a power tool.

These and other objects of the invention are achieved by the drive system according to the present invention for engaging a small diameter abrasive disc with a power tool. The drive system includes an arbor which is adapted to engage the power tool. The arbor includes a shaft portion formed on one end and external threads formed on the other end. The external threads have a first pitch. In one preferred embodiment, the threads on the arbor have a pitch of about 0.135 inches.

The drive system also includes an abrasive disc backing plate which has a mount extending outward from the backing plate on one side of the backing plate. The mount has internal threads formed on it for threadingly engaging the threads formed on the arbor. The engagement of the threads in the mount with the threads on the arbor provide a rigid attachment for facilitating rotation of the disc by the power tool when the arbor is engaged with the power tool. The threads on the mount having a second pitch which is different from the first pitch. In one embodiment, the threads on the mount have a second pitch of about 0.125 inches.

The arbor also has a stop located between the shaft portion and the external threads which limits the extent of engagement between the threads in the mount and the threads on the arbor by contact between the mount and the stop. The location of the stop on the arbor is selected to permit complete engagement of the arbor with the disc after the disc is turned between about ¼ and about 1½ turns.

The backing plate in the drive system is preferably made from approximately 33% glass filled nylon. The backing plate also preferably includes a plurality of abrasive flaps bonded to the backing plate. Each abrasive flap overlaps at least a portion of an adjacent abrasive flap.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

FIG. 9 is a plan view of an small diameter finishing disc according to the invention.

FIG. 10 is a partial section view of the small diameter finishing disc shown in FIG. 9 illustrating the novel drive system.

FIG. 11 is an exploded view of the of the drive system according to the present invention.

DETAILED DESCRIPTION OF THE PREFERRED EMBODIMENTS

Figure 1A:
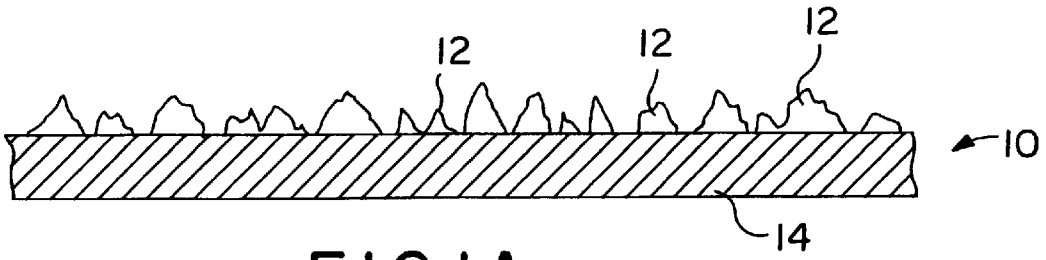
FIG. 1A PRIOR ART
FIG. 1A is an enlarged cross-sectional view of the surface of a prior art resin fiber disc before use.
Figure 1B:
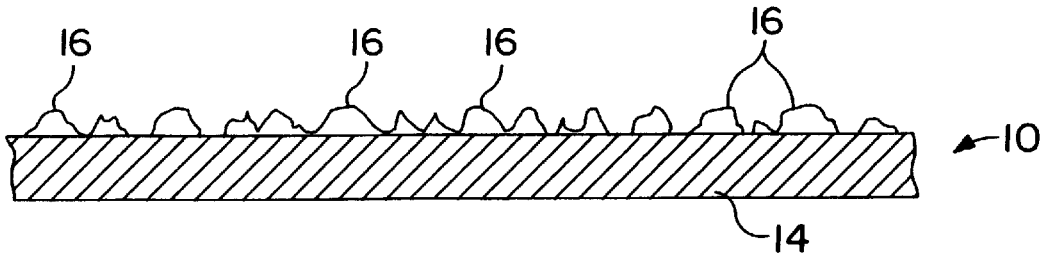
FIG. 1B PRIOR ART
FIG. 1B is an enlarged cross-sectional view of the surface of a prior art resin fiber disc after use.
Figure 2:
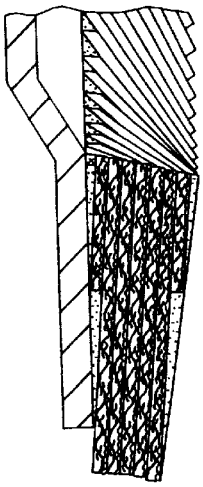
FIG. 2 PRIOR ART
FIG. 2 is a detail view of a conventional flap disc.

Referring now to the drawings, wherein like reference numerals illustrate corresponding or similar elements throughout the several views, as FIGS. 1A and 1B illustrate the problem of wear associated with conventional flap discs. FIG. 2 illustrates a conventional flap disc in more detail.

Figure 3:
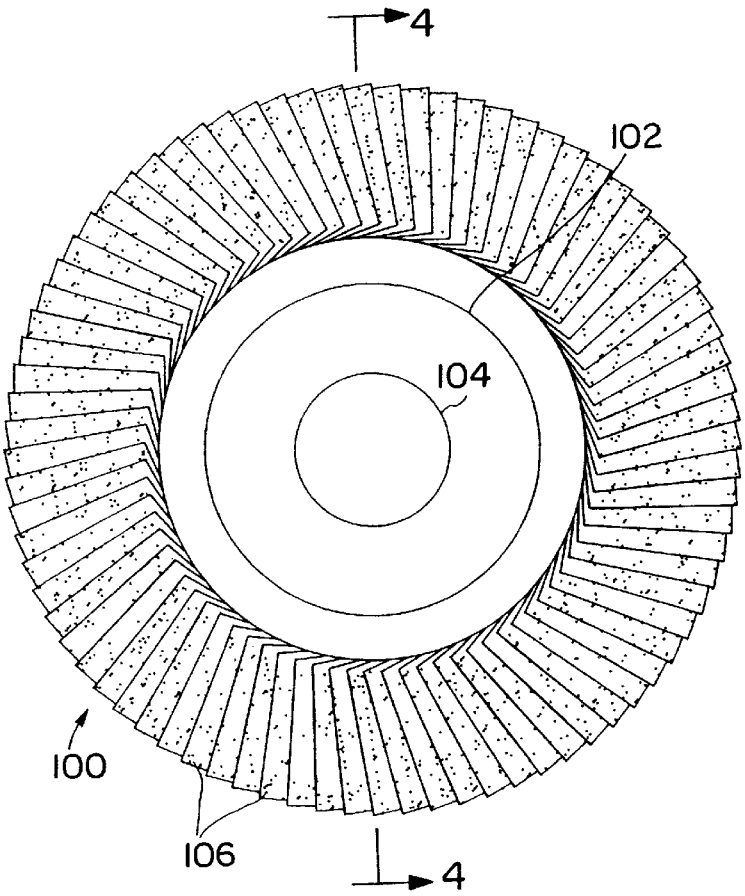
FIG. 3 is a plan view of an improved finishing disc according to the invention.

FIG. 3 illustrates a plan view of a novel surface finishing disc 100. The disc shown is a large diameter disc that utilizes a separate mounting nut to engage the disc with a power tool (not shown). The disc is a flap disc which includes a plurality of abrasive flaps 106 arranged in an overlapping fashion around the periphery of the disc 100. The abrasive flaps 106 are arranged such that, when the disc 100 is attached to a power tool and brought into contact with a work surface (not shown), the rotation of the disc 100 causes the abrasive flaps 106 to sand or abrasively wear away the work surface. FIGS. 4–8 illustrate other features of the flap disc. The details of this surface finishing disc are disclosed in related application Ser. No. 08/546,970, entitled "Flap Disc Abrasive Tool", filed Oct. 23, 1995. This related application is incorporated by reference in its entirety into the present application. While FIGS. 3–8 illustrate a large diameter disc, the general configuration and attachment of the flaps to the disc is readily applicable to small diameter discs as discussed below with respect to one embodiment of the invention. For the sake of thoroughness, a short discussion of the flaps follows with reference to com FIGS. 3–8. FIGS. 9–13 illustrate a novel drive system according to the present invention.

Figure 4:
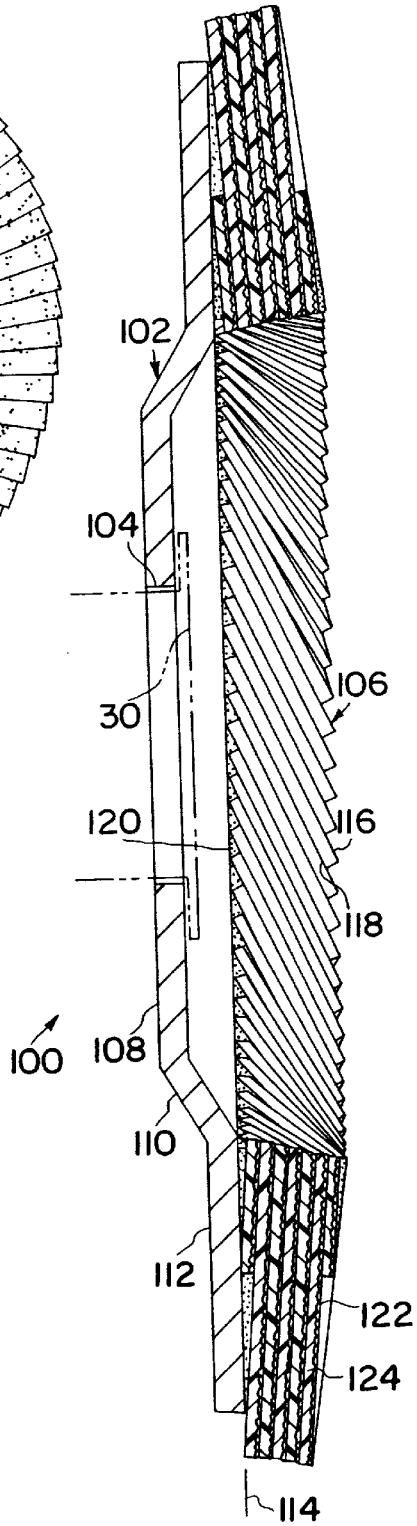
FIG. 4 is a cross-sectional view of the finishing disc taken along lines 4—4 in FIG. 1.

As shown in FIGS. 3 and 4, each abrasive flap 106 has an outer surface 116 and an inner surface 118. The abrasive flaps 106 are depicted as rectangular in shape, although other shapes may be used without departing from the invention. The outer surfaces 116 define the finishing surface of the disc 100.

A portion of the inner surface 118 of each abrasive flap 106 is attached to a mounting flange 112 on the backing plate 102 by means of an adhesive 120. The adhesive 120 is preferably chosen to work well under the high pressure and temperature conditions present during a normal finishing operation. In the preferred embodiment, the adhesive 120 is an epoxy type of adhesive. Naftotec™ manufactured by Chemetall is an example of such an adhesive.

Figure 5A:
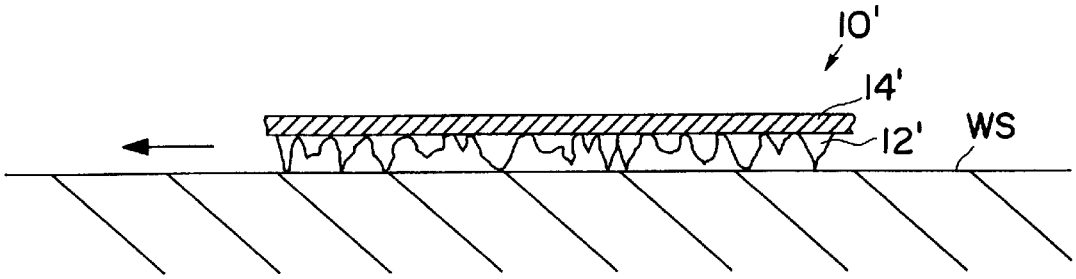
FIG. 5A PRIOR ART
FIG. 5A is an enlarged view showing contact between a planar abrasive disc and a work surface.
Figure 5B:
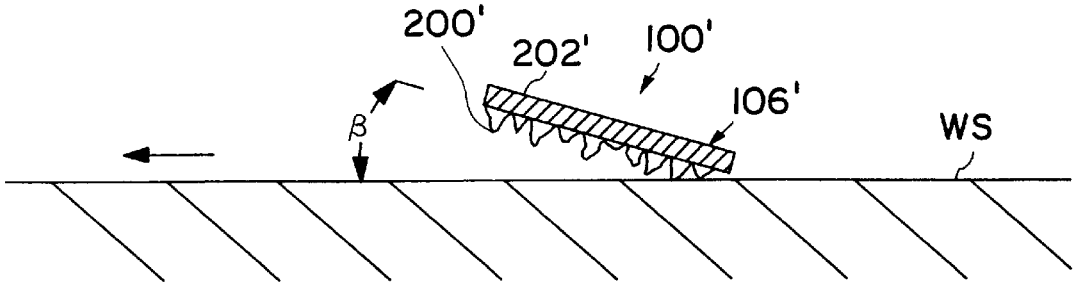
FIG. 5B is an enlarged view showing contact between an abrasive flap according to the present invention and a work surface.
Figure 6:
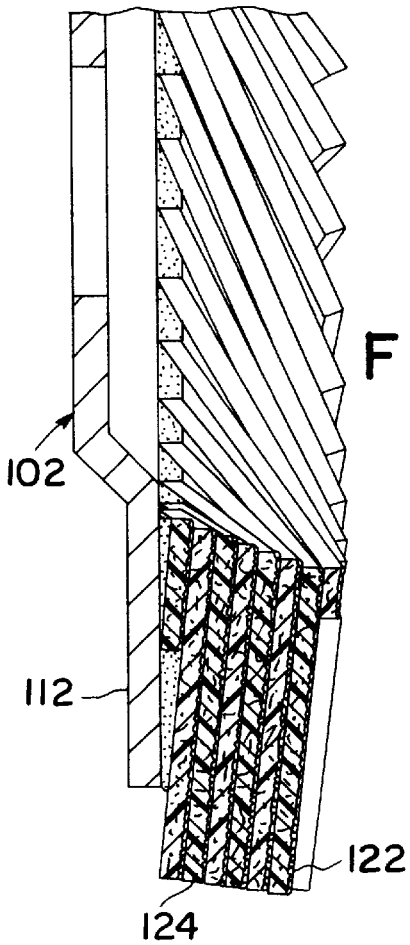
FIG. 6 is a detail view of an alternate embodiment of a finishing disc according to the present invention.

The bonding of a portion of the inner surface 118 to the mounting flange 112, in combination with the overlapping arrangement of the abrasive flaps 106 upon one another, results in the outer surface 116 being positioned at an angle with respect to the plane 114 defined by the mounting flange 112. The angular position of the outer surface 116 of the abrasive flaps 106 defines the point of contact between the finishing disc 100 and the work surface. It is this portion of the abrasive flaps 106 which will begin to wear first. FIGS. 5A and 5B compare the contact between a conventional planar resin fiber disc designated 10' and a flap disc designated 100'.

Referring to FIG. 4, in one embodiment, the abrasive flaps 106 have an abrasive finishing layer 122 which includes abrasive particles such as aluminum oxide. The finishing layer 122 is attached to a substrate 124, preferably by means of a phenolic resin binder. In one embodiment, the substrate 124 comprises a fiber material coated with a resin binder to form a resin fiber layer. The resin is, preferably, a phenolic resin, such as Cascophen™ manufactured by Borden, and the fiber material is, preferably, a vulcanized cotton material. Other materials, such as fiberglass, may be utilized in the substrate so long as the chosen material is capable of breaking away after the abrasive particles have worn. The fiber substrate in this embodiment retains the abrasive particles until they are sufficiently worn, at which point the loads applied to the abrasive flaps 106 cause the particles to tear away and expose new abrasive material.

Figure 8:
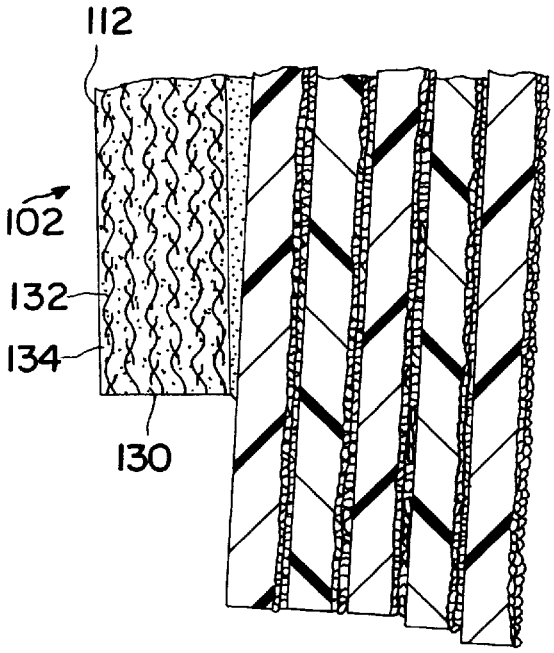
FIG. 8 is an enlarged view of the embodiment of the finishing disc shown in FIG. 7.
Figure 7:
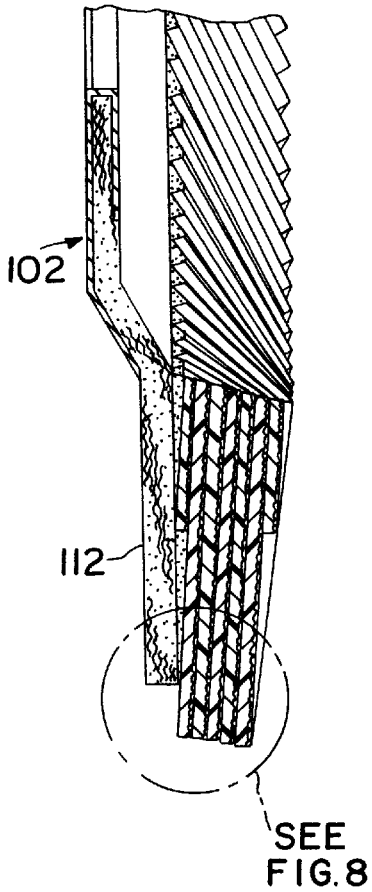
FIG. 7 is a detail view of a finishing disc according to the present invention with an alternative backing plate embodiment.

In an alternative flap disc configuration, shown in FIG. 8, the substrate 124 comprises a non-woven abrasive fabric, such as crimped staple fibers sold under the registered trademark "Scotch-Brite" by the 3M Company of St. Paul, Minn. and disclosed in U.S. Pat. No. 2,958,593. The finishing layer 122 is formed by bonding an abrasive particle and resin combination to the surface of the non-woven fiber substrate 124. The finishing layer 122 may be manufactured separately then subsequently bonded to the top of the substrate 124. Alternately, and more preferably, the abrasive particle and resin combination of the finishing layer 122 is coated onto the upper portion of the non-woven fibers of the substrate 124 so that the resin bonds to the fibers of the substrate thereby forming an integral combination. The non-woven fabric may comprise randomly oriented nylon fibers bonded with a phenolic resin. Accordingly, the non-woven fibers are continuous between the substrate 124 and the finishing layer 122. This type of material is commonly referred to as "surface conditioning".

In the alternative configuration of the non-woven fiber substrate embodiment discussed above, abrasive particles and resin may be located throughout the non-woven fabric of the substrate 124. Hence, the finishing layer 122 effectively forms a substantial portion, if not the entire, substrate 124. As the uppermost abrasive particles are torn off of the substrate, new abrasive particles will continuously be exposed to the work surface. The resin also assists in stabilizing the substrate 124 so as to provide a relatively rigid foundation for holding the abrasive particles.

Referring now to FIG. 9, one preferred embodiment of a small diameter surface finishing disc 300 is shown. The disc 300 includes a plurality of abrasive flaps 302 attached to a backing plate 304. The flaps 302 are the same as the flaps 106 described in detail above with respect to FIGS. 3–8, and they need not be described further.

The backing plate 304 is similar to the backing plate 102 described above with respect to the large diameter finishing disc. Referring to FIG. 10, the backing plate 304 includes a mount 306 extending outward from the backing plate 304 on the side of the backing plate that is opposite to the abrasive flaps 302. The mount includes a rim 308 extending around the periphery of the distal end of the mount 306. The mount 306 is preferably formed integral with the backing plate 304. However, it is also contemplated that the mount 306 can be a separate component that is attached to the backing plate 304.

The backing plate 302 has an aperture 310 formed in it which extends through the mount 306. The aperture 310 preferably extends completely through the mount 306 and the entire thickness of the backing plate 304. A set of internal threads 312 is formed in the mount 306 within the aperture 310. As will be discussed in more detail below, the threads are chosen to provide a rigid threaded attachment of a drive arbor (discussed below) to the disc 300.

The size and shape of the backing plate 304 may vary depending on, but not limited to, the speed at which the disc 300 is to be rotated, the configuration of the abrasive on the disc 300 (e.g., flaps, pads), the type of power tool to which the disc is to be attached, and the drive system chosen for the disc 300. Those skilled in the art will understand and appreciate the diverse backing plate 304 configurations which may be practiced within the scope of this invention. While the above discussion has described a flap type abrasive disc, the present invention also contemplates the use of any other configuration of abrasive material that is mounted onto a backing plate, such as a planar abrasive disc.

During normal finishing operations, the backing plate 304 may come into contact with the work surface. That is, all the abrasive material on the disc 300 may, eventually, wear or tear off exposing the work surface to the backing plate 304. As a consequence, the backing plate 304, which is typically made from a rigid material such as aluminum, steel, or composite material, may contact the work surface and cause damage to the workpiece, or worse, the backing plate may break apart causing injury to the operator. To prevent this problem from occurring, the backing plate 304 in the present invention is made from a glass filled polymer, such as Nylon 6/6 glass filled distributed by Polymerland, Parkersburg, W.Va. Preferably, the backing plate is approximately 33 percent glass filled nylon. However, it is also contemplated that the backing plate could be made with between about 10% and about 35% glass filled nylon, although 33% is the most preferred.

A drive arbor 314 is shown threadingly engaged with the disc 300. The arbor 314 includes a shaft portion 316 and a threaded end 318. A stop 320 is located between the threaded end 318 and the shaft portion 316. The stop 320, threaded end 318, and shaft portion 316 are preferably all formed as an integral piece. The arbor is preferably made from steel material, although other materials, such as brass, can be readily substituted therefor. The shaft portion 316 preferably has a ¼ inch or 6 millimeter outer diameter, which are conventional arbor diameters for mounting in a standard power tool chuck.

The threaded attachment between the threaded end 318 of the arbor 314 and the threads 312 formed within the mount 306 is chosen to prevent tear out of the plastic material between the threads in the mount 306. The threads are also selected to require a minimal amount of turning of disc 300 for complete engagement/disengagement with arbor 314. Moreover, as will be discussed below, the thread combination is selected to provide the least amount of friction prior to binding.

Figure 12:
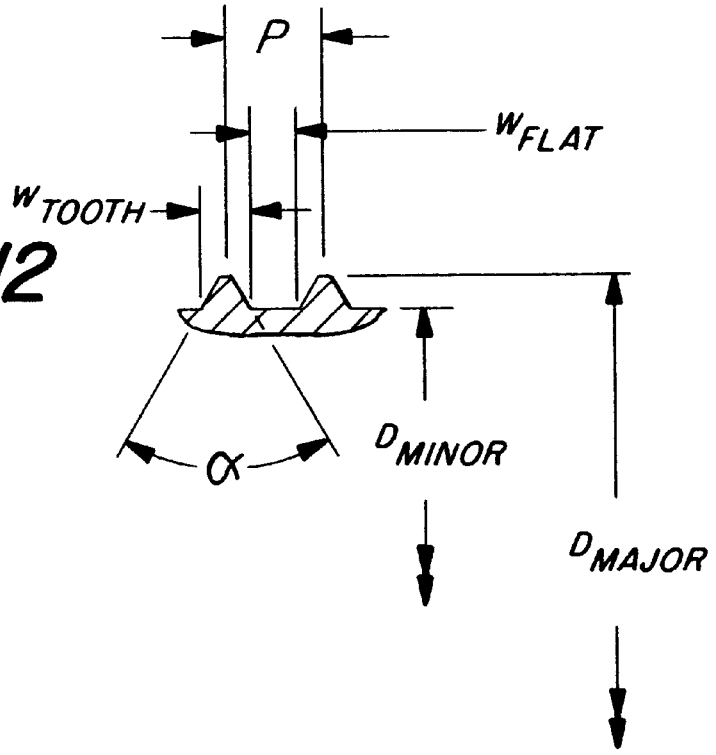
FIG. 12 is a partial section view of the threaded end of the arbor.

The threaded end 318 of the arbor 314 preferably includes external threads. There are preferably 7⅜ths threads per inch with a pitch diameter of 0.360 inches. A suitable range of threads per inch for the threaded end 318 of the arbor is between about 6 and 10 threads per inch (e.g., a pitch of between 0.167 inches and about 0.1 inches). FIG. 12 is a partial section view of the teeth on the threaded end 318 of the arbor 314, and shows a representative example of thread dimensions. In the example illustrated, the angle $\alpha$ is preferably approximately 60°. The pitch, P, is about 0.135 inches. The width of a tooth, $W_{TOOTH}$, at the base (minor diameter) is about 0.085 inches. The width of the root, $W_{FLAT}$, at the base is about 0.050 inches. The major diameter, $D_{MAJOR}$, is about 0.500 inches and the minor diameter, $D_{MINOR}$, is about 0.350 inches.

Figure 13:
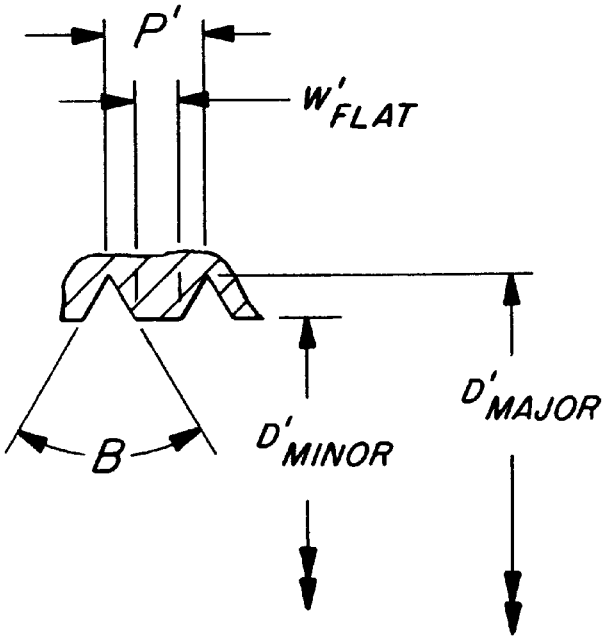
FIG. 13 is a partial section view of the threads within the mount on the backing plate.

The mating threads 312 formed in the mount 306 are internal threads and have 8 threads per inch. FIG. 13 is a partial section view of the teeth in the mount 306 of backing plate 304. The teeth are chosen to mate with the exemplary thread dimensions of the arbor illustrated in FIG. 12. The angle $\beta$ is preferably approximately 60°. The pitch, P', is about 0.125 inches. A suitable range of threads per inch for the threads 312 on the mount 306 is between about 6 and 10 threads per inch (e.g., a pitch of between 0.167 inches and about 0.1 inches). The width of the root, $W'_{FLAT}$, at the base is about 0.048 inches. The major diameter, $D'_{MAJOR}$, is about 0.500 inches and the minor diameter, $D'_{MINOR}$, is about 0.360 inches. The pitch diameter is about 0.360 inches.

In one preferred embodiment of the modified pitch design, the pitch diameters, minor diameters, and major diameters are almost, if not identical between the arbor and the mount. It should be noted that the major diameter shown in FIG. 12 is only approximate since the tips of the external threads are typically rounded slightly. Thus, the actual major diameter of the external threads will be slightly less than the major diameter of the internal threads. A variety of variations of thread design are contemplated for use in the present invention. Those skilled in the art would readily appreciate such diverse arrangements in light of the present disclosure.

As is evident from the above selection of threads, the threads on the threaded end 318 of the arbor 314 do not have the same number of threads per inch as the threads 312 on the mount 306. As such, the threads 318 on the arbor 314 will bind (lock) with the threads 312 on the mount 306 within the last 60° to 90° of rotation of the backing plate with respect to the arbor. This provides a unique locking arrangement for preventing inadvertent disengagement of the mount 306 from the arbor 314. This is especially important when a finishing disc utilizing the present invention is mounted onto a power tool with a braking system. It is also contemplated that the threads on the mount and arbor may be designed such that only a portion of the thread pitch on these components differ. Preferably the pitch between the threads on the arbor and the threads in the mount differ from one another by approximately 90% to 95%. That is, the pitch of the threaded end is about 90% to 95% different than the pitch in the mount.

Thread configurations such as the example described result in a substantial amount of plastic material in the backing plate between threads. This large amount of material prevents shear tear-out of the arbor from the backing plate 304 during use. Tear out of the threads could result in the backing plate breaking, which could pose a potential threat to the operator. In one preferred embodiment, there is between about 2 and 3 times as much material between threads in the mount as compared to the area of an individual tooth on the arbor.

Thread configurations such as that described above also minimize the extent to which the backing plate 304 must be turned to engage/disengage the disc 300 to/from the arbor 314, thereby allowing the operator to quickly and easily change the abrasive disc 300. Also, the different thread pitch between the threads on the arbor 314 and the threads in the mount 306 provides low frictional contact between the threads prior to the binding (locking) after approximately 1 rotation.

The stop 320 limits the extent to which the backing plate 304 is threaded onto the arbor 314. As shown in the figures, the stop preferably is a flange integral with the arbor and which has an outer diameter large enough to contact the rim 308 on the mount 306. Specifically, the backing plate 304 is turned until the rim 308 comes into contact with the stop 320. In one exemplary embodiment, the stop 320 has an outer diameter greater than about 0.500 inches. In the most preferred embodiment, the stop has an outer diameter of about 0.625 inches. The stop 320 is axially located on the arbor 314 so as to contact the rim 308 and prevent further rotation of the disc 300 after approximately 1¼ turns of the disc. This is the preferred location of the stop 320 on the arbor 314. However, it is contemplated that the stop 320 can be located such that number of turns of the disc 300 until rim 308 contacts the stop 320 is in a range of between approximately ¼ to 1½ turns.

The stop also provides a means for aligning the arbor 314 and the backing plate 304. As discussed above, the rim 308 preferably contacts the stop 320 on the arbor 314 when the backing plate 304 is fully engaged with the arbor 314. The flat contact surface of the rim 308 facilitates the alignment of backing plate perpendicular to an axis of rotation 400 (which runs along the longitudinal axis of the arbor 314). By aligning the backing plate properly, wobbling of the disc is prevented. Accurate alignment also prevents improper finishing which would otherwise occur due to uneven contact.

While the stop has been illustrated and described as part of the mount, alternate locations for the stop are feasible and well within the scope of the invention. Moreover, the alignment between the backing plate and the axis of rotation of the arbor can be provided by other well known means also within the scope of the invention.

It is also contemplated that the attachment between the disc and the arbor can be provided by alternate connections designed to facilitate quick engagement and disengagement For example, in one contemplated embodiment, the arbor has an external attachment, such as a bayonet-type fitting. The bayonet-type fitting is configured to engage with a slot formed in the mount. Turning of the bayonet-type fitting with respect to the mount locks the disc to the arbor.

In yet another embodiment contemplated, the external attachment on the arbor is at least one lug extending laterally out of the side of the arbor. The lug is designed to engage with a slot formed in the mount. Turning of the lug with respect to the slot while the lug is located within the slot locks the arbor into engagement with the disc. Those skilled in the art would readily appreciate the various other embodiments for attaching the arbor to the disc which can be practiced within the purview of the accompanying claims.

Although the invention has been described and illustrated with respect to the exemplary embodiments thereof, it should be understood by those skilled in the art that the foregoing and various other changes, omissions and additions may be made therein and thereto, without departing from the spirit and scope of the present invention.

What is claimed:

1. A drive system for engaging a small diameter abrasive disc with a power tool, the drive system comprising:

an arbor for engaging the power tool, one end of the arbor comprising a shaft portion and the other having external threads formed on it, the external threads having a first substantially constant pitch; and an abrasive disc backing plate having a mount extending outward from the backing plate on one side of the backing plate, the mount having internal threads formed on it for threadingly engaging the threads formed on the arbor, the engagement of the threads in the mount with the threads on the arbor providing a rigid removable attachment for facilitating rotation of the disc by the power tool when the arbor is engaged with the power tool, the threads on the mount having a second substantially constant pitch, the second pitch being different from the first pitch wherein the backing plate is made from a glass filled polymer.

2. A drive arbor and small diameter abrasive disc combination, the drive arbor for engaging the small diameter abrasive disc with a power tool, the drive arbor comprising:

a shaft portion located at one end of the arbor, the shaft portion having an outer diameter adapted to engage the power tool;

external threads formed on the other end of the arbor, the external threads having a first substantially constant pitch;

a stop located between the shaft portion and the external threads for limiting the extent of engagement between the threads on the arbor and the threads in the disc by contact between the disc and the stop, the location of the stop on the arbor being selected to permit complete engagement of the arbor with the disc after the disc is turned between about ¼ and about 1½ turns; and the abrasive disc comprising a backing plate having a mount extending outward from the backing plate on one side of the backing plate, the mount having internal threads formed on it for threadingly engaging the threads formed on the arbor, the engagement of the threads in the mount with the threads on the arbor providing a rigid removable attachment for facilitating rotation of the disc by the power tool when the arbor is engaged with the power tool, the threads on the mount having a second substantially constant pitch, the second pitch being different from the first pitch wherein the backing plate is made from a glass filled polymer.

3. A drive system according to claim 1 wherein the glass-filled polymer is between about 10% and about 35% glass-filled nylon.

4. A drive system according to claim 3 wherein the glass filled polymer is approximately 33% glass filled nylon.

5. A drive system for engaging a small diameter abrasive disc with a power tool, the drive system comprising:

an arbor for engaging the power tool, one end of the arbor comprising a shaft portion and the other having external threads formed on it, the external threads having a first substantially constant pitch;

an abrasive disc backing plate having a mount extending outward from the backing plate on one side of the backing plate, the mount having internal threads formed on it for threadingly engaging the threads formed on the arbor, the engagement of the threads in the mount with the threads on the arbor providing a rigid removable attachment for facilitating rotation of the disc by the power tool when the arbor is engaged with the power tool, the threads on the mount having a second substantially constant pitch, the second pitch being different from the first pitch; and a plurality of abrasive flaps bonded to the backing plate.

6. A drive system according to claim 5 wherein each abrasive flap overlaps at least a portion of an adjacent abrasive flap and wherein the abrasive flaps are disposed about the periphery of the backing plate.

7. A drive system according to claim 1 wherein the first pitch is in a range between approximately 0.167 inches and approximately 0.1 inches.

8. A drive system according to claim 7 wherein the first pitch is about 0.135 inches.

9. A drive system according to claim 1 wherein the second pitch is about 0.125 inches and the first pitch is about 0.135 inches.

10. A drive system according to claim 1 wherein the difference between the first pitch and the second pitch is in a range between about 90% and 95%.

11. A drive system according to claim 1 wherein the difference between the first and second pitch provides frictional contact of the threads on the mount with the threads on the arbor about 60° to 90° before a stop on the arbor contacts the mount.

12. A drive system according to claim 1 further comprising a stop located between the shaft portion and the external threads for limiting the extent of engagement between the threads in the mount and the threads on the arbor by contact between the mount and the stop, the location of the stop on the arbor being selected to permit complete engagement of the arbor with the disc after the disc is turned between about ¼ and about 1½ turns.

13. The drive system according to claim 12 wherein the stop is a flange which is integral with the arbor and which has an outer diameter greater than 0.500 inches.

14. A drive system according to claim 12 wherein the stop assists in aligning the backing plate perpendicular to an axis of rotation of the arbor.

15. A drive system according to claim 12 wherein the first pitch is in a range between approximately 0.167 inches and approximately 0.1 inches.

16. A drive system according to claim 15 wherein the first pitch is about 0.135 inches.

17. A drive system according to claim 12 wherein the second pitch is about 0.125 inches and the first pitch is about 0.135 inches.

18. A drive system according to claim 12 wherein the difference 0 between the first pitch and the second pitch is in a range between about 90% and 95%.

19. A drive system according to claim 12 wherein the difference between the first and second pitch provides frictional contact of the threads on the mount with the threads on the arbor about 60° to 90° before the stop contacts the mount.

* * * * *